US005187532A

United States Patent [19]

McNew

[11] Patent Number: 5,187,532

[45] Date of Patent: Feb. 16, 1993

[54] ELECTROSTATIC DOCUMENT COPYING SYSTEM HAVING SHEET ROLLS SUPPORTED BY TELESCOPING CANTILEVERED ARMS

[75] Inventor: Thomas A. McNew, Oklahoma City, Okla.

[73] Assignee: Digital Magnetic Systems, Inc., Oklahoma City, Okla.

[21] Appl. No.: 787,784

[22] Filed: Nov. 4, 1991

[51] Int. Cl.[5] ..... G03G 21/00

[52] U.S. Cl. ..... 355/309; 242/58; 242/58.6; 242/75.4

[58] Field of Search ..... 355/308, 309, 310, 311; 242/58, 58.6, 68, 68.4, 75.4, 129

[56] References Cited

U.S. PATENT DOCUMENTS

| | | | |
|---|---|---|---|
| 1,433,849 | 10/1922 | Rosener | 242/68 |
| 1,731,963 | 10/1929 | Zusmer | 242/129.6 |
| 3,730,452 | 5/1973 | Schwartz | 242/68.4 |
| 3,843,253 | 10/1974 | Mikan et al. | 242/58 |
| 3,845,915 | 11/1974 | Schmidt et al. | 242/68.4 |
| 3,900,256 | 8/1975 | Ravera et al. | 355/310 X |
| 3,941,328 | 3/1976 | Johnson | 242/68.4 |
| 4,259,008 | 3/1981 | Yamagata et al. | 355/309 X |
| 4,270,911 | 6/1981 | McNew | 493/410 |
| 4,365,733 | 12/1982 | McNew | 226/109 |
| 4,541,710 | 9/1985 | McLeish | 355/309 X |
| 4,893,763 | 1/1990 | Wales et al. | 242/58.6 |
| 4,941,607 | 7/1990 | Schlunke | 226/189 |

*Primary Examiner*—A. T. Grimley
*Assistant Examiner*—J. E. Barlow, Jr.
*Attorney, Agent, or Firm*—Laney, Dougherty, Hessin & Beavers

[57] ABSTRACT

An electrostatic document copying system which includes an electrostatic plain paper engineering copying machine having a copy paper feed rack secured thereto, and copy paper guide channels adjustably secured thereto in copy paper-receiving alignment with copy paper rolls supported on the feed rack. The copy paper feed rack includes a frame attachable to the copier, and carrying a plurality of cantilevered, telescoping copy paper roll-supporting arms. These arms are individually selectively extensible. They are arranged to cooperatively cradle and support a plurality of continuous copy paper rolls to facilitate simultaneous feeding of copy papers from multiple rolls. A plurality of original documents can thus be simultaneously copied. The apparatus is especially adapted for copying elongated oversized documents, such as oil well logs.

19 Claims, 3 Drawing Sheets

ELECTROSTATIC DOCUMENT COPYING SYSTEM HAVING SHEET ROLLS SUPPORTED BY TELESCOPING CANTILEVERED ARMS

FIELD OF THE INVENTION

This invention relates to systems for electrostatically simultaneously copying a plurality of elongated, oversized documents.

BACKGROUND OF THE INVENTION

1. Brief Description of the Prior Art

Recent developments in electrostatic copying, and particularly xerography, have permitted many new copying techniques to be quickly and efficiently performed. So-called engineering copiers capable of reproducing blue line prints, sepias, CAD plots and cut-and-tape composites in high quality copies are now economically available and in widespread usage. Originals as large as thirty-six inches in width, and of great length can be copied, and copiers which can simultaneously make multiple copies of multiple original documents are in use.

In my U.S. Pat. No. 4,270,911, I have described an accessory or adjunct to a xerographic copier which permits elongated oil and gas well logs to be easily and accurately copied onto a specially prepared copy paper which is fed from a roll mounted on a special roll-supporting stand which is positioned adjacent the xerographic copier. Elongated electrocardiograms and computer printouts can be similarly copied.

In my U.S. Pat. No. 4,365,733, I describe a xerographic copying machine by means of which a plurality of elongated fan-folded original documents can be concurrently fed through the copier, along with a wide copy paper capable of having both of the original documents simultaneously copied thereon. The copy paper is fed from a roll supported on a stand placed adjacent the copier. The copy roll-supporting stand can continuously feed rolls of widely varying widths of copy paper to the copier.

2. Brief Description of the Present Invention

The present invention provides an electrostatic copying system which is quite versatile in its utility, and which includes, inter alia, a copying capability which enables it to simultaneously copy a plurality of original oversized elongated documents. The originals are copied onto a plurality of elongated individual copy papers fed at independent speeds from a plurality of copy rolls mounted immediately adjacent the copier. The system is especially adapted to the copying of multiple elongated oil and gas logs to yield copies of consistently high quality. As many as six different half-sized well logs can be concurrently copied. Alternatively, a single oversize document of up to thirty-six inches in width can be copied on correspondingly sized copy paper.

Broadly described, the electrostatic document copying system of the invention includes a plain paper engineering copier of xerographic type which can receive variously configured oversized and regular original documents from a location adjacent the top of the copier. In a preferred mode of operation, a plurality of elongated, fan-folded, transversely perforated original documents can be fed from a series of feed trays mounted at the top of the copier and these feed trays may be of the type described in my U.S. Pat. No. 4,365,733, or they may be multi-part magnetic bin feeders of the type described in my U.S. Pat. No. 4,486,093.

Carried on the forward (operator) side of the copier is a copy roll paper feeding rack which can adjustably support from one to six variously sized rolls of copy paper at selected distances from the copier. From two to six rolls of copy paper can be simultaneously fed to the copier in synchronism with a corresponding or greater number of original documents (in the latter case, for example, two originals may be placed on a single copy roll). The feeding rack is detachably mounted on the copier to facilitate removal when desired in order to permit certain other types of document reproduction to be carried out.

Paired copy paper guide channels are detachably mounted on the copier in copy paper-receiving alignment with each copy paper roll supported on the feed rack. The copy paper guide channels are quickly adjustable to accommodate them to the guidance of copy paper of varying widths. The copy paper feed rack includes a frame attachable to the copier for orientation in a substantially horizontal plane. The feed rack carries a plurality of horizontally spaced, cantilevered telescoping copy paper roll-supporting arms. The roll-supporting arms are individually, selectively extensible. They are arranged to cooperatively cradle and support a plurality of contiguous copy paper rolls to facilitate simultaneous feeding of copy paper from multiple rolls. Such simultaneous feeding permits a plurality of original documents to be simultaneously copied in this system. Individual braking elements are carried on the free outer ends of each of the copy paper roll-supporting arms, and each braking element bears against an adjacent copy paper roll to prevent it from feeding copy paper too rapidly into the copy paper machine, to stabilize and guide the flow of the copy paper, and to prevent the copy paper roll from undergoing backlash of the copy paper carried thereon.

An important object of the present invention is to provide a multiple copy paper feeding device which permits elongated, oversized plain copy paper to be fed into an electrostatic copier at a controlled rate with the feed of copy paper from each of several rolls proceeding simultaneously.

Additional objects and advantages of the present invention will become apparent as the following detailed description of a preferred embodiment of the invention is read in conjunction with a perusal of the accompanying drawings which illustrate such preferred embodiment.

GENERAL DESCRIPTION OF THE DRAWINGS

FIG. 1 is a perspective view from above and forward of an electrostatic document-copying system for simultaneously copying a plurality of elongated oversized documents, which system is constructed in accordance with the present invention. An existing electrostatic copier which can be especially beneficially used as a part of the system of the invention is the Xerox 2520 Engineering Copier manufactured and sold by the Xerox Corporation of Rochester, N.Y. It is shown in dashed lines. Shown in full lines are the multiple copy roll paper feeding rack and guide channels which are quick detachably secured to the electrostatic copier.

DETAILED DESCRIPTION OF A PREFERRED EMBODIMENT OF THE INVENTION

Figure 1:
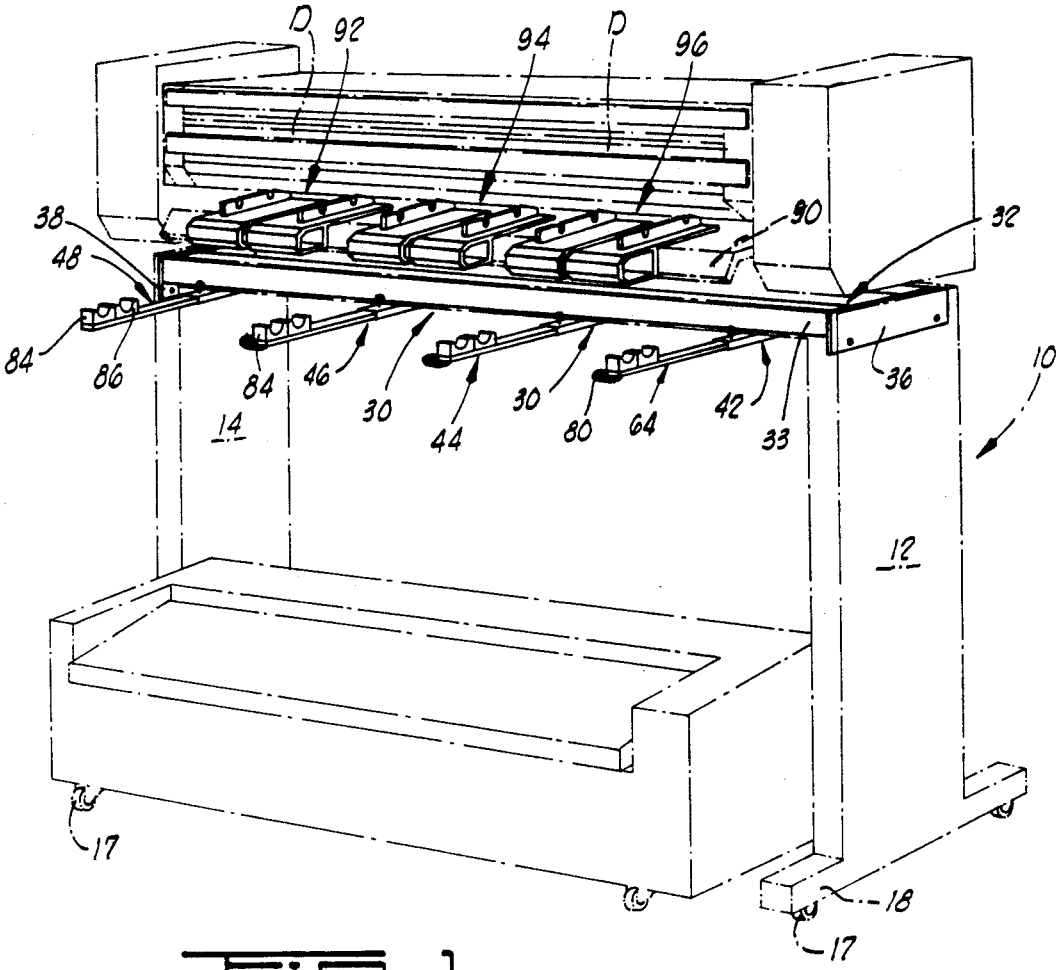

Referring initially to FIG. 1 of the drawings, the electrostatic oversized document copying system of the invention includes an electrostatic engineering copier apparatus 10. Such copier apparatus provides elements needed for transferring indicia through a process of electrostatic copying from an elongated, continuous original document onto an elongated, continuous copy paper as both are moved concurrently through the copier. Devices of this type are well known in the art. A typical widely used engineering copier for copying such oversize documents is the Xerox 2520 machine manufactured and sold by the Xerox Corporation of Rochester, N.Y.

The described copier is that which is schematically illustrated in the drawings, and there denominated by reference numeral 10. The copier 1( includes a pair of upright standards 12 and 14 disposed at opposite ends thereof, with these standards each being supported at its lower end on a horizontal support bar 18. The support bar 18 may carry on their lower sides, casters 17, flat supporting pads or other elements for supporting the copying machine on a floor. A solid, horizontally extending plate 22 (see FIGS. 4 and 5) extends across the space between, and interconnects, the standards 12 and 14, and carries a pair of parallel flanges 26 located at the front and back of the copier, and also a second pair of flanges 28 located at opposite sides of the copier (see FIG. 2). A downwardly opening internal space is defined between the flanges 26 and 28 and beneath the plate 22.

Figure 2:
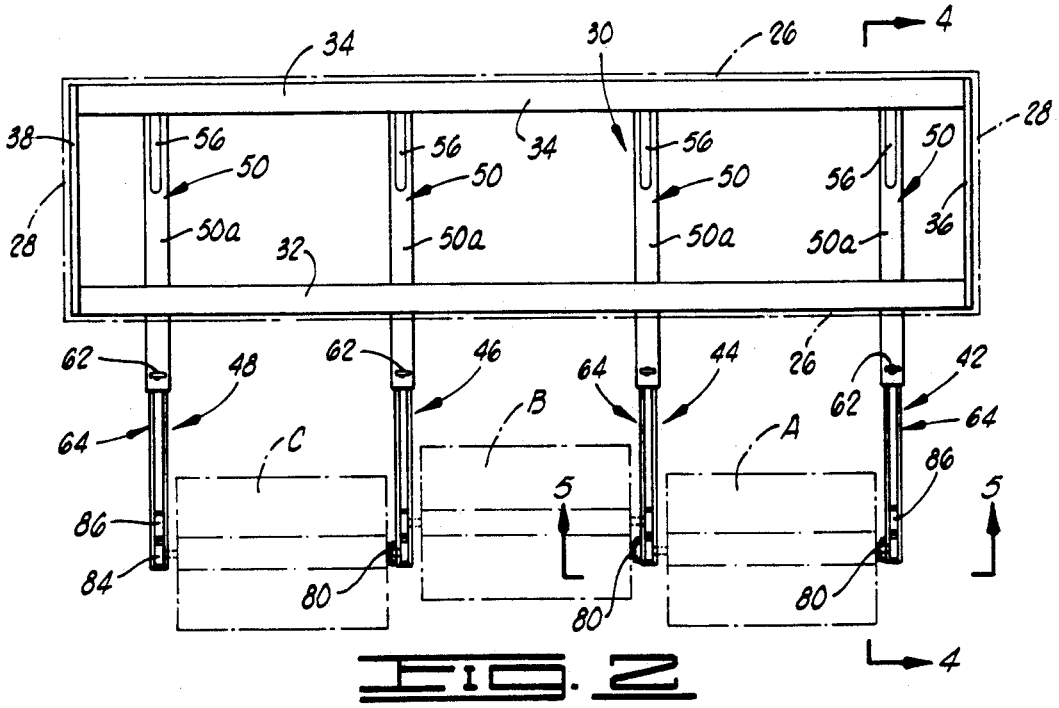
FIG. 2 is a plan view of the multiple copy roll paper feeding rack depicted in full lines in FIG. 1, and showing, in dashed lines, three rolls of elongated, continuous copy paper supported thereon in a position to simultaneously feed the copy paper from the three rolls into the electrostatic copying machine.
Figure 4:
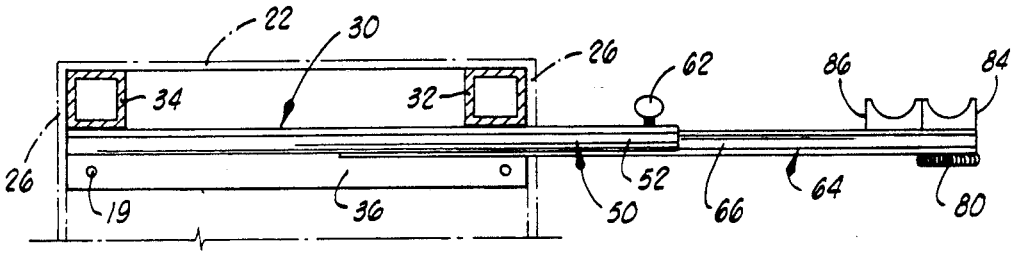
FIG. 4 is a sectional view taken along line 4—4 of FIG. 2.
Figure 5:
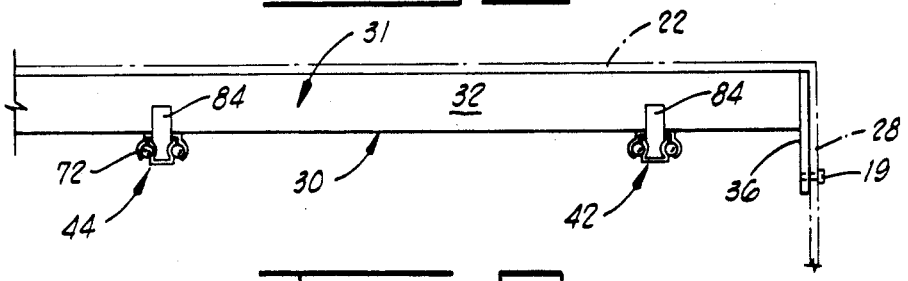
FIG. 5 is a front elevation view of a part of the multiple copy roll paper feeding rack illustrated in FIG. 2.

A copy paper feeding rack is an important subassembly used in the electrostatic document copying system of the invention. The copy paper feeding rack is denominated generally by reference numeral 30. The copy roll feeding rack 30 in the illustrated embodiment of the invention includes a generally rectangular frame 31. The frame 31 includes a pair of elongated, substantially parallel pipes or tubing sections 32 and 34 each having a rectangular cross-section. These tubing sections 32 and 34 constitute a front frame member and a rear frame member, as illustrated in FIGS. 2 and 4. The frame 31 further includes a pair of horizontally extending parallel, downwardly extending flanges 36 and 38 which are located in a pair of horizontally spaced, substantially vertical planes. As will be noted in referring to FIGS. 2, 4 and 5, the flanges 36 and 38 are apertured to provide a situs facilitating the detachable securement of the copy paper feeding rack 30 to the copier 10 by suitable screws 19 (see FIG. 5) extended through the holes in the flanges 36 and 38 and aligned holes in the flanges 28 on the copier. As portrayed in the figures of the drawings, the flanges 36 and 38 are positioned by their location on the frame 32 such that they are immediately adjacent the upright standards 12 and 14.

When the rectangular frame 31 is positioned between the upright standards 12 and 14 of the copier 10 as shown in FIGS. 1 and 2, the paper feeding rack 30 presents a plurality of outwardly extending, horizontally spaced substantially parallel, copy roll-supporting arms. Four of these are preferably utilized and are denominated in the drawings by reference numerals 42, 44, 46 and 48. It will be noted in referring to the drawings that the two outermost supporting arms 42 and 48 are spaced inwardly along the framework 31 from the flange plates 36 and 38, and the two remaining supporting arms 44 and 46 are spaced from each other and from the supporting arms 42 and 48, so that three equisized copy paper rolls, "A", "B" and "C", can be supported on these four arms in the manner and at the positions illustrated in FIG. 2 of the drawings.

Figure 6:
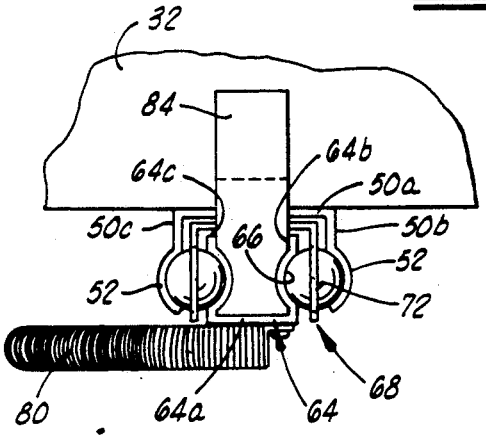
FIG. 6 is an enlarged detail view showing the bearing structure by which a part of each of the telescoping cantilevered copy roll-supporting arms is permitted to reciprocate in order to selectively change its overall length.
Figure 7:
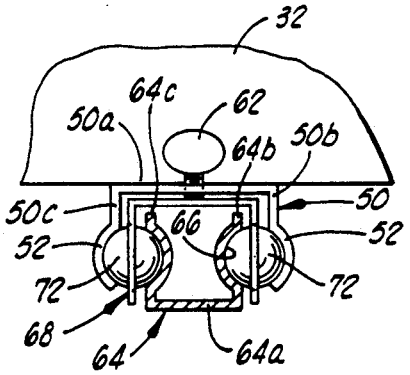
FIG. 7 is an enlarged detail view taken along line 7—7 on FIG. 3 and further illustrating the bearing structure.

The construction of each of these roll-supporting arms 42, 44, 46 and 48 can best be discerned by reference to FIGS. 3-6, and the ensuing discussion. The four supporting arms illustrated in the drawings and used in the here described embodiment of the invention are identically constructed. Thus, each includes an elongated, external sleeve 50 which is of a generally C-shaped, cross-sectional configuration. The sleeve 50 thus includes a web portion 50*a*, forming the upper side of the external sleeve, and a pair of downwardly depending, horizontally spaced legs 50*b* and 50*c* (see FIGS. 2, 3 and 6). Each of the spaced legs 50*b* and 50*c* form a semicircular outward bulge or elongated, round-bottomed recess 52 so that the concavity of the recess faces inwardly into the interior of the external sleeve, and the convex surface on the opposite side of the recess faces outwardly. This is also shown in FIGS. 6 and 7.

The web portion 50*a* of each external sleeve 50 is utilized for securing the sleeve to the underside of the cross members 32 and 34 of the framework 31. Securement of the sleeves 50 to the cross members of the framework functions to secure the respective cantilevered copy roll-supporting arms 42-48 on the rectangular frame 31. An elongated slot 56 is formed in the internal end portion of each of the external sleeves 50.

Figure 3:
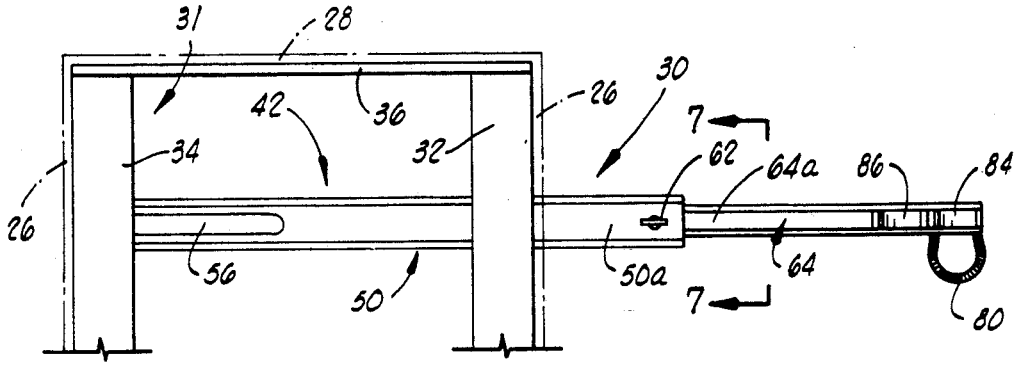
FIG. 3 is an enlarged plan view of one end portion of the multiple copy roll paper feeding rack forming a part of the electrostatic copying system of the invention. A part of the associated electrostatic copier is shown in dashed lines.

At the opposite end of each of the external sleeves 50 from that end which carries the elongated slot 56, each sleeve has a threaded aperture formed therein to permit a flat headed set screw 62 to be threaded through the opening in the external sleeve. In this way, the screw 62 can engage an elongated, internal rod 64 which also forms a part of each of the telescoping, cantilevered copy paper roll-supporting arms 42–48. The construction of each elongated internal rod 64 is best illustrated in FIGS. 3, 4 and 6 of the drawings. Each of the internal rods 64 is mounted within an associated external sleeve 50 for reciprocation in the sleeve and relative to the copier 10. The mounting facilitating reciprocation of the rod 64 in this fashion will be subsequently described. Each of the elongated internal rods 64 is of an inverted, U-shaped configuration, and thus has a downwardly facing, horizontally extending bridging web 64*a*, and a pair of spaced, upwardly extending legs 64*b* and 64*c*. Each leg 64*b* and 64*c* is inwardly indented or grooved to form an outwardly facing concavity therein which is in the form of an elongated groove or trough 66, as best illustrated in FIGS. 4, 6 and 7.

In order to enable the elongated internal rod 64 to slide easily within the C-shaped external sleeve 50, a ball bearing race 68 is mounted between the external sleeve and the internal rod 64. The elongated ball bearing race is of a U-shaped configuration and includes a pair of spaced, parallel elongated legs joined to a web portion. The legs are provided at longitudinally spaced intervals therealong with keeper apertures or holes in each of which is mounted a spherical element or ball 72 which is permitted to roll freely against either the concavity defining surfaces 66 of the rod 64, or the concave recess 52 in one of the legs 50*b* or 50*c* of the external sleeve 50. By reason of this bearing arrangement, best shown in FIG. 7, the elongated internal rod 64 can reciprocate freely within the external sleeve 50 until its position is fixed by threading the set screw 62 inwardly until the inner end of the screw bears firmly against the web portion of the rod at a selected location therealong. This locks the rod 64 against movement relative to the external sleeve 50, and sets the overall length of the telescoping, cantilevered roll-supporting arm.

At its outer end, each of the cantilevered copy roll-supporting arms 42–48 carries a friction braking element 80. In the embodiment of the invention here illustrated, the friction braking element 80 is a resilient, semicircular, coiled spring. Each of the coiled spring braking elements 80 is mounted on the outer end of the elongated internal rod of the respective cantilevered roll-supporting arm so as to bear against the side of a roll of copy paper mounted upon, and supported by, an adjacent pair of the elongated copy paper roll-supporting arms. The way in which each of the spring-type braking elements 80 bears against a side of one of the rolls of copy paper in order to apply a frictional drag to the roll, and prevent overrunning or backlash, is best illustrated in FIG. 2. Here it will be perceived that the semicircular spring 80 mounted on the outer end of the internal rod 64 projects toward the adjacent supporting arm by a distance sufficient to bring the spring into frictional contact with the adjacent roll of copy paper.

In order to rollably support a relatively large diameter roll of elongated copy paper in a position to allow the copy paper to be fed through the copier, each of the supporting arms 42–48 carries at its free outer end, spaced outwardly from the copier, a roll-supporting means to permit this result to be achieved. In the illustrated embodiment of the invention, a pair of adjacent roll-supporting cradle blocks 84 and 86 are frictionally retained in abutting relation to each other within the channel which is formed along the elongated internal rod (see FIG. 6). Thus, the arrangement of the cradle blocks 84 and 86 can be clearly perceived by reference to FIGS. 3–6. Each of the cradle blocks has a pair of indentations or concave grooves formed adjacent the base thereof which permit it to fit snugly within the respective U-shaped elongated internal rod (see FIG. 6), with a portion of each of the cradle blocks projecting upwardly from this rod and carrying a concave, roller hub supporting recess in the cradle block (see FIG. 4). This is true of the adjacent cradle block 86 which is identically configured to the cradle block 84.

Where two of the cradle blocks are used in tandem in their mounting on the outer end of each of the cantilevered copy roll supporting arms 42–48, it is then possible to mount the three copy paper rolls, "A", "B" and "C", in staggered relationship as shown in FIG. 2 so that supporting arms 44 and 46 actually function to support the opposite ends of the roll "B" while supporting one end of the roll "A" and one end of the roll "C" in the outermost of the concavely recessed cradle blocks carried in the two supporting arms.

In the use of the electrostatic document copying system of the invention, a plurality of oversized, elongated documents can be simultaneously copied onto equally oversized elongated sheets as such are continuously fed to the copier from the roll feeding rack 30. The drag imposed on each of the rolls of copy paper as its diametric size changes, with such drag being imposed by the frictional contact of the coiled arcuate springs 80, prevents each roll from overrunning as a result of the momentum it has developed during feeding, or from backlashing by rolling in a reverse direction due to sudden start ups and stops. When it is not desired to concurrently feed elongated copy papers from one or several copy paper rolls carried on the copy roll feeding rack 30, the rack can be quickly detached from the copier by the simple expedient of removing the screws or fastener elements 19 and simply pulling the rack outwardly after moving it downwardly so as to allow the frame members 32 and 34 to clear the downwardly projecting flanges 26 of the copier.

Figure 12:
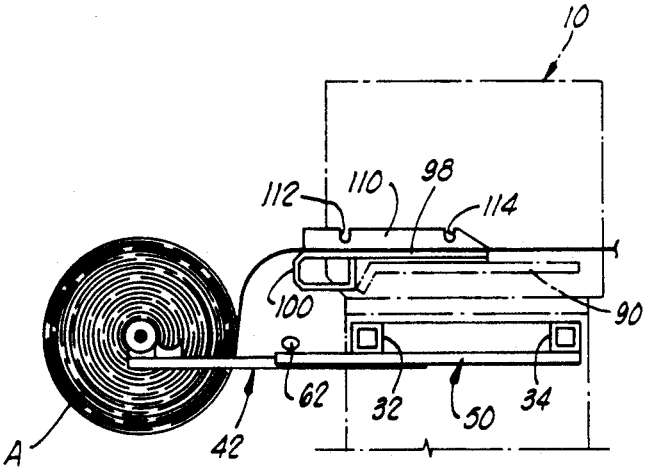
FIG. 12 is a diagrammatic illustration depicting the manner in which an elongated copy paper is fed from a roll into the copier in the document copying system of the invention. The copier is illustrated in dashed lines.

As reference is made to FIG. 1, it will be perceived that there are three pairs of copy paper guide channel halves mounted upon the paper guide ramp 90 carried on, and forming a part of, the copier 10. The three pairs of copy paper guide channel halves are denominated by reference numerals 92, 94 and 96. In each of the pairs 92, 94 and 96 there are two guide channel halves which are identical, except that one half is shaped to function as a right hand guide channel half, and the other half forms a left hand guide channel half. The manner in which the pairs 92, 94 and 96 of copy paper guide channels function for guiding elongated copy paper passed therethrough into the copy machine 10 will be hereinafter described and is best illustrated in FIGS. 1, 2 and 12.

One of the halves of a pair of the copy paper guide channels is illustrated in detail in FIGS. 8–11. The paper guide channel half there shown is a left hand guide channel half. It is identically constructed to the right hand paper guide channel half, except for the location of a vertically extending guide plate carried thereon, which guide plate will be hereinafter described.

Figure 8:
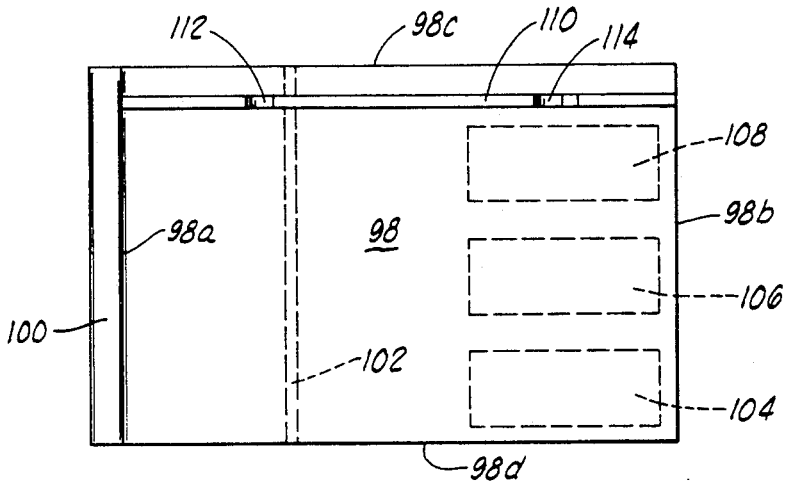
FIG. 8 is a plan view of one of the guide channel halves which is quick detachably mounted on the copier to guide copy paper from a copy paper roll into the copier.

Referring to FIG. 8 of the drawings, the copy paper guide channel half includes a relatively large rectangular monoplanar slide plate 98. The rectangular slide plate 98 is preferably made of clear plastic and is characterized in having an outer end edge 98*a* an inner end edge 98*b* and a pair of parallel side edges 98*c* and 98*d*. The outer end edge 98*a* of the rectangular plate 98 is joined to a curved or angled abutment face 100 which, in the illustrated embodiment, is made by folding or bending the plastic making up the plate 98 about four parallel lines defining three segments occupying different planes and thus forming the rounded end face 100 shown in the illustrated embodiment. A sufficiently long plastic plate will permit yet a further structural element in the form of a reinforcing abutment plate 102 to be extended at a right angle to a bottom plate 101 and joined at its upper side to the under side of the rectangular side plate 98. Thus, all of the structure described thus far can be formed from a single plate of synthetic resin or plastic material with appropriate molding, or bending along the parallel lines illustrated in FIG. 11 and facilitating the realization of the illustrated geometric configuration.

In the illustrated embodiment of the invention, three magnetic tabs 104, 106 and 108 of rectangular configuration are secured to the underside of the rectangular slide plate 98 at a location adjacent the inner end edge 98*b*. The magnetic tabs 104, 106 and 108 are spaced from each other across the width of the rectangular slide plate. The magnetic tabs function to detachably retain the copy paper guide channel half at a selected location on the upper surface of the paper guide ramp 90 as shown in FIG. 1.

Secured along the upper side of the rectangular paper slide plate 98 is an elongated, vertically extending edge guide plate 110. Edge guide plate 110 has a lower edge which is coextensive in length with the length of the rectangular paper slide plate 98. An upper edge 111 extends parallel to the lower edge, and defines a pair of indexing slots or recesses 112 and 114 along its length. The indexing recess 112 is referred to as the outer recess and the recess 114 is referred to as the inner recess. The functions of these recesses will be hereinafter described.

Figure 9:
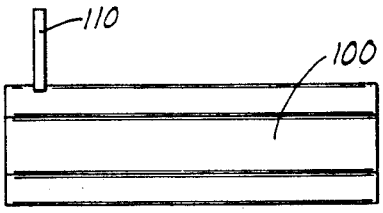
FIG. 9 is a front elevation view of the guide channel half as it appears when viewed by one standing in front of the copier machine.
Figure 11:
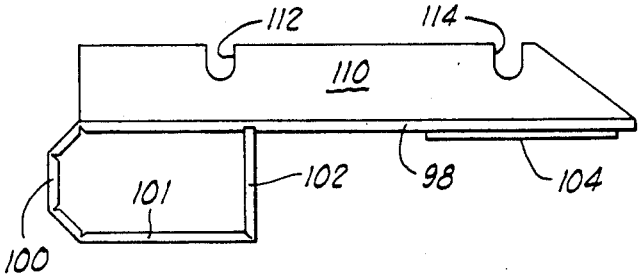
FIG. 11 is a side elevation view of the guide channel half depicted in FIGS. 8-10.
Figure 10:
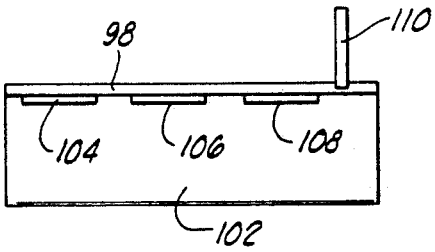
FIG. 10 is a rear end elevation view showing the appearance of the guide channel half illustrated in FIGS. 8 and 9 as that structure appears when viewed from the opposite side thereof from the side portrayed in FIG. 9.

As has been previously indicated, the copy paper guide channel half illustrated in FIGS. 8–11 is a left hand guide channel half. It functions in cooperation with a right hand guide channel half which is constructed identically to the left hand half shown in FIGS. 8–11 except for having the edge guide plate 110 located on the opposite side of the flat paper slide plate 98. In other words, if the guide channel half depicted in the drawings is viewed as it appears as one operates the system, and thus appears at that time as shown in FIG. 9, this left hand guide channel half would be placed to the left of an identically constructed right guide channel half located immediately to the right of the left guide channel half. The two edge guide plates 110 carried on the two guide channel halves would be adjustably spaced apart from each other by precisely the width of an elongated copy paper to be guided therethrough and into the copy machine as it passes from a roll of the copy paper carried on the copy roll paper feeding rack 30. The two copy paper guide channels are retained in their guiding positions on the copier by the magnets 104, 106 and 108, and by the abutment constituted by the abutment plate 102. This plate 102 abuts against the edge of the paper guide ramp 90 in the copier to function in positioning the guide channel half in the manner illustrated in FIGS. 1 and 11 of the drawings. The paper passes through feed rolls (not visible) located inside the copier 10 and is fed through the path necessary to effect the xerographic copying desired. The copies, when completed, are discharged from the copier at the location "D" shown in FIG. 1.

At times it is advantageous to correlate the feeding of the copy paper roll with certain indicia from the copied original so that the indicia will appear at the desired location on the header or at the top of the copy paper (i.e., adjacent the leading end). The operator of the system is visually apprised of the precise time to insert the original document described by the passage of a transversely extending index bar printed on the copy paper which passes by one or two index notches 112 and 114 carried on the upright guide plate 110. Thus, as the index bar passes the notch 112, this indicates to the operator that the next original document should be inserted. This will assure that indicia transferred to the copy paper roll from the original will appear at the proper location on the copy paper. When the index bar printed on the different size of copy paper roll passes the notch of recess 114, then a corresponding different size original document should be inserted. This assures that indicia from the original document will be copied at the place desired on the copy.

FIG. 12 of the drawings is a diagrammatic illustration in which the elongated copy paper is shown being fed from one of the rolls "A" supported on the copy roll feeding rack 30 through the copier 10 via one of the paper guide channels 96. The elongated paper 122 has been previously fan-folded before placing it in the roll "A" of copy paper and has been transversely perforated at spaced intervals therealong, all as described in my U.S. Pat. No. 4,270,911.

In the us of the electrostatic document copying system of the invention, the copy roll paper feeding rack 30 is initially attached to the electrostatic copier apparatus 10 by the use of screws or other suitable fasteners 19 extended through the holes or apertures formed in the horizontally extending flanges 36 and 38 carried at the opposite ends of the frame 31. After the frame has been secured to the copier 10 as illustrated in FIG. 1, the outwardly extending, horizontally spaced, substantially parallel, cantilevered copy roll-supporting arms 42, 44, 46 and 48 are independently adjusted in their overall length. The arm array will generally include at least two arms which have been adjusted t make their lengths equal. In this way, the spindle upon which the copy paper is rolled can be rollably supported by reception of the opposite ends of the spindle in an aligned pair of the supporting cradle blocks 84 or 86. With precise transverse alignment of these cradle blocks in an adjacent pair of cantilevered copy roll-supporting arms, such as the arms 42 and 44, the copy paper will run true through the aligned pair 96 of copy paper guide channel halves and into the copier 10 where the indicia carried by an original document, such as an elongated well log, will be transferred by a xerographic copying process to the copy paper.

As the paper feeds from the copy roll into the copier, the speed is maintained uniform and the paper is prevented from advancing too fast or undergoing backlash by the drag effect exerted on the paper rolls by the several friction braking elements 80.

On some occasions, it may be desirable to move all of the copy paper rolls much closer to the copier than they are shown in FIG. 2 of the drawings. This may, for example, sometimes be desirable in order to permit the originals, following copying, to gravitate downwardly into a reception bin (not shown) located below the copy roll feeding rack 30 in the copying system of the invention.

Other forms of the copy roll feeding rack can be made up and used in conjunction with the copier apparatus 10. Thus, a very wide roll of copy paper extending up to thirty-six inches in width can be supported between the paired cradle blocks, 84 or 86, carried on two of the copy roll-supporting arms, such as the arms 42 and 48, spaced widely apart on the frame 31.

Although a preferred embodiment of the invention has been herein described, the structural details which have been articulated in the foregoing description are intended to be essentially illustrative and not limiting. Other forms of the structure can function essentially equivalently to deliver the same result in substantially the same way, thus appropriating the essential principles of the invention. It is requested that in acknowledgment of this, the appended claims be given the broadest scope which can be reasonably assigned thereto in order to protect against unwarranted and unjustified utilization of this invention.

What is claimed is:

1. An electrostatic document copying system comprising:

an electrostatic paper copier; and a copy paper feeding rack detachably connected to said copier, said paper feeding rack comprising:

a frame;

means for detachably connecting said frame to said copier;

a plurality of horizontally extending, horizontally spaced, substantially parallel, telescoping copy roll-supporting arms each supported as a cantilever on, and projecting from, said frame; and means for selectively setting the length of each of said telescoping roll-supporting arms.

2. An electrostatic document copying system as defined in claim 1 and further characterized as including roll-supporting cradle means carried on each of said arms adjacent a free end of each of said cantilevered roll-supporting arms.

3. An electrostatic document copying system as defined in claim 2 wherein said cradle means comprises a pair of adjacent cradle blocks in longitudinal alignment on the free end portion of each of said cantilevered roll-supporting arms, each of said cradle blocks having an upwardly opening concavity therein.

4. An electrostatic document copying system as defined in claim 1 and further characterized as including braking means secured to a free end of each of said cantilevered roll-supporting arms and extending laterally therefrom in the direction of an adjacent roll-supporting arm.

5. An electrostatic document copying system as defined in claim 1 wherein each cf said copy roll-supporting arms comprises:

an elongated external sleeve of U-shaped, cross-sectional configuration and having a web along one side thereof secured to said frame;

an elongated internal rod of U-shaped, cross-sectional configuration telescoped into said external sleeve and having a web at one side thereof and an opening at the other side thereof facing the web of said sleeve; and ball bearings positioned between said external sleeve and said internal rod and rollably supporting said rod in said sleeve for reciprocating movement relative thereto.

6. An electrostatic document copying system as defined in claim 5 wherein said length setting means comprises a set screw extending adjustably through the sleeve of each arm into close proximity to the respective rod of that arm.

7. An electrostatic document copying system as defined in claim wherein said frame includes a pair of horizontally spaced, parallel flanges, and said detachably connecting means comprises fastening elements extendable through said flanges and into engagement with said copier.

8. An electrostatic document copying system as defined in claim 1 and further characterized as including paper guiding means mounted on said copier in alignment with, and facing the space between, two of said supporting arms for receiving copy paper continuously fed from a roll of elongated copy paper rollably mounted between said two supporting arms.

9. An electrostatic document copying system as defined in claim 8 wherein said guiding means comprises a pair of paper guide channels slidably and detachably mounted on said copier at a location between paper gripping and advancing rolls within said copier and free, outer, roll-supporting ends of said copy roll-supporting arms, said guide channels in said pair being movable toward, and away from, each other to accommodate varying widths of copy paper.

10. An electrostatic document copying system as defined in claim 9 and further characterized as including means for slidably and magnetically retaining said guide channels on said copier.

11. An electrostatic document copying system as defined in claim 9 wherein each of said guide channels includes an upright edge guiding plate occupying a vertical plane extending parallel to the direction of movement of copy paper from said copy paper roll into said machine.

12. An electrostatic document copying system as defined in claim 11 and further characterized as including means for slidably and magnetically retaining said guide channels on said copier.

13. An electrostatic document copying system as defined in claim 8 and further characterized as including braking means secured to a free end of each of said cantilevered roll-supporting arms and extending laterally therefrom in the direction of an adjacent roll-supporting arm.

14. An electrostatic document copying system as defined in claim 8 wherein each of said copy roll-supporting arms comprises:

an elongated external sleeve of U-shaped, cross-sectional configuration and having a web along one side thereof secured to said frame;

an elongated internal rod of U-shaped, cross-sectional configuration telescoped into said external sleeve and having a web at one side thereof and an opening at the other side thereof facing the web of said sleeve; and ball bearings positioned between said external sleeve and said internal rod and rollably supporting said rod in said sleeve for reciprocating movement relative thereto.

15. An electrostatic document copying system as defined in claim 14 wherein said guiding means comprises a pair of paper guide channels slidably and detachably mounted on said copier at a location between paper gripping and advancing rolls within said copier and free, outer, roll-supporting ends of said copy roll-supporting arms, said guide channels in said pair being movable toward and away from each other to accommodate varying widths of copy paper.

16. An electrostatic document copying system as defined in claim 8 wherein said length setting means comprises a set screw extending adjustably through the sleeve of each arm into close proximity to the respective rod of that arm.

17. Apparatus for concurrently feeding multiple rolls of elongated copy paper to an electrostatic copier, said apparatus comprising:

a generally rectangular frame including:

apertured flanges at opposite sides of the frame; and elongated frame members projecting between said flanges and supporting them; and a plurality of elongated telescoping, cantilevered copy roll-supporting arms secured to said frame and including:

an elongated external sleeve connected to a pair of said frame members;

an elongated rod slidably and reciprocally mounted in said sleeve and having a free end portion projecting out of said sleeve;

cradle means carried on the free outer end of each of said rods for rotatably supporting a roll of elongated copy paper;

means for selectively fixing said rod within said sleeve at a desired position to thereby define the overall length of the respective supporting arm; and ball bearing means positioned between said sleeve and a portion of the rod within said sleeve to rollably support said rod in said sleeve.

18. Apparatus for concurrently feeding multiple rolls of elongated copy paper as defined in claim 17 and further characterized as including a resilient drag brake secured to each of said arms adjacent an outer end thereof and facing toward an adjacent one of said arms in a position to be in frictional engagement with a roll of elongated copy paper carried on said arms.

19. Apparatus for concurrently feeding multiple rolls of elongated copy paper as defined in claim 17 wherein said external sleeve is substantially C-shaped in cross-sectional configuration and includes:

a web portion; and a pair of substantially parallel legs, each having an outwardly bulging, elongated groove therealong having a concave inwardly facing side open to receive a portion of a spherical bearing element; and wherein said elongated rod is of U-shaped cross-section and includes:

a web portion spaced from, and extending substantially parallel to, the web portion of said sleeve; and a pair of substantially parallel legs extending from said web portion of the rod toward the web portion of the external sleeve, and being positioned within said sleeve and extending substantially parallel to the legs thereof, said legs of said rod each having an inwardly extending elongated groove therein and defining a concavity facing outwardly toward the adjacent leg of said sleeve; and a ball bearing race positioned between said sleeve and said rod; and spherical bearing elements carried in said ball bearing race and confined therein by the elongated grooves formed in the legs of said rod and said sleeve.

* * * * *

UNITED STATES PATENT AND TRADEMARK OFFICE

CERTIFICATE OF CORRECTION

PATENT NO. : 5,187,532

DATED : February 16, 1993

INVENTOR(S) : Thomas A. McNew

It is certified that error appears in the above-indentified patent and that said Letters Patent is hereby corrected as shown below:

Column 3, line 56, delete "1(" and insert --10-- therefor.

Column 8, line 34, delete "us" and insert --use-- therefor.

Column 8, line 46, delete "t" and insert --to-- therefor.

Column 10, line 9 (Claim 7, line 2), after "claim", insert --1--.

Signed and Sealed this

Twelfth Day of July, 1994

Bruce Lehman

*Attest:*

BRUCE LEHMAN

*Attesting Officer*

*Commissioner of Patents and Trademarks*